US007201118B2

(12) United States Patent
Lenz et al.

(10) Patent No.: US 7,201,118 B2
(45) Date of Patent: Apr. 10, 2007

(54) PISTON-COOLING ARRANGEMENT FOR AN INTERNAL COMBUSTION ENGINE

(75) Inventors: Ingo Lenz, Cologne (DE); Dietmar Laufenberg, Windeck (DE); Carsten Weber, Leverkusen (DE); Urban Morawitz, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/324,449

(22) Filed: Jan. 3, 2006

(65) Prior Publication Data

US 2006/0169224 A1 Aug. 3, 2006

(30) Foreign Application Priority Data

Jan. 3, 2005 (EP) ..... 05100002

(51) Int. Cl.
*F01P 1/04* (2006.01)

(52) U.S. Cl. ..... 123/41.35; 123/196 R

(58) Field of Classification Search ..... 123/196 R, 123/41.35

See application file for complete search history.

(56) References Cited

U.S. PATENT DOCUMENTS

| | | | | |
|---|---|---|---|---|
| 4,010,718 | A | 3/1977 | Stewart | |
| 5,533,472 | A | 7/1996 | Sands et al. | |
| 6,532,912 | B2 | 3/2003 | Moller et al. | |
| 7,077,096 | B2 * | 7/2006 | Matsuda | 123/196 R |
| 2004/0055545 | A1 * | 3/2004 | Baldwin | 123/41.35 |

* cited by examiner

*Primary Examiner*—Noah P. Kamen
(74) *Attorney, Agent, or Firm*—Diana D. Brehob

(57) ABSTRACT

The invention relates to an internal combustion engine having a piston-cooling arrangement (1) which has at least one spray device (2, 27; 2, 39) which is supplied with a coolant/lubricant via at least one supply passageway (3). The supply passageway (3) is arranged in a module (4) composed of a crankshaft-bearing structural element (6) and a crankshaft-bearing cap (7). The spray device (2, 27; 2, 39) is coupled to the crankshaft-bearing cap (7), a crankshaft-bearing shell (14) in the region of the supply passageway (3). Supply passageway (3) also connect to through-opening (16), so that coolant/lubricant can be directed via the supply passageway (3) to both the spray device (2, 27; 2, 39) and a crankshaft (17). The spray device (2) is designed as an oil-spray nozzle (27) or alternatively as a spray hole (39) integrated in the crankshaft-bearing cap (7).

18 Claims, 13 Drawing Sheets

PISTON-COOLING ARRANGEMENT FOR AN INTERNAL COMBUSTION ENGINE

FIELD OF THE INVENTION

The invention relates to an internal combustion engine having a piston-cooling arrangement which has at least one spray device which is supplied with a coolant/lubricant via at least one supply passageway.

BACKGROUND OF THE INVENTION

U.S. Pat. No. 6,532,912 B2 relates to piston cooling for internal combustion engines having a crankshaft, a plurality of pistons and a crankcase. The crankcase is split up into divided regions by a plurality of partition walls, a forced-feed lubrication system being integrated in the crankcase, so that lubricant can circulate through the crankcase. In addition, the crankcase has a plurality of longitudinal bores which extend through a respective partition wall of the crankcase generally coaxially to one another and generally parallel to the crankshaft. The piston-cooling system has a plurality of bores which are each incorporated in the respective partition wall and are connected to the force-feed lubrication systems. In addition, the piston-cooling system has a plurality of spray nozzles, of which each is individually fitted in an associated longitudinal bore and is directed to spray lubricant onto an underside of the piston. The spray nozzles are connected to a respective bore and to the forced-feed lubrication system. Each spray nozzle is designed as a compact turned part and has a transverse bore with opposite open ends. The open ends are each closed with a stopper. In addition, the spray nozzle has two spray holes which are symmetrical relative to the center, the lubricant flowing through the inlet bore to pass into the closed transverse bore and sprayed out of the spray holes. The inlet bore aligns with the bore of the respective partition wall in which the spray nozzle is fitted.

U.S. Pat. No. 4,010,718 discloses a reciprocating internal combustion engine having a cylinder block containing at least one cylinder, at least one piston reciprocating in the associated cylinder, a crankcase, a crankshaft rotatably mounted in the crankcase in at least one bearing, and at least one connecting rod for connecting the crankshaft to the associated pistons. The crankcase is provided with a lubricating-oil passage. The crankcase has a bore in each case between a main bearing and the associated piston, this bore being connected to the lubricating-oil passage. A tubular nozzle assembly is firmly fitted into the bore of the crankcase in a precisely predetermined position. The nozzle assembly has an inner cavity which is connected to the lubricating-oil passage. In addition, the lubricating-oil assembly has at least one nozzle passage which has been formed on the nozzle assembly in a precisely predetermined position before the nozzle assembly is fitted into the associated bore.

U.S. Pat. No. 5,533,472 relates to an oil-jet-nozzle piston-cooling arrangement for an internal combustion engine having two adjacent cylinders, in which reciprocating pistons are mounted. A crankshaft space is arranged between the cylinders, a crankshaft being arranged with at least one lubricating bearing in the crankshaft space. The cylinder block has journals between the adjacent cylinders to carry the crankshaft bearing. An oil feed passage is incorporated in the cylinder block to direct lubricating oil to the journal and to the bearing. A groove is incorporated in the cylinder block, at least one section of the groove being connected to the crankshaft journal to obtain lubricating oil from the feed line. A first passage is incorporated in the cylinder block, this first passage extending between the adjacent cylinders essentially parallel to the crankshaft and being arranged above the crankshaft journal. A second passage is incorporated in the cylinder block, this second passage extending between the groove and the first passage. The oil-spray-nozzle piston-cooling system has a spray arrangement which has an inlet end and an opposite outlet end. Oil passes through the inlet end into the spray nozzle, this oil being sprayed out through the outlet end. The spray nozzle is fitted in the second passage, so that its outlet end is adjacent to the groove to obtain oil from the journal, so that its outlet end is open to the first passage to produce oil streams which spray upwards through the first passage and the cylinders against the underside of the adjacent pistons.

However, U.S. Pat. No. 5,533,472 also relates to an internal combustion engine having a cylinder block which accommodates reciprocating pistons inside a piston cylinder. A connecting rod connects the piston to a crankshaft. The cylinder block has a crankshaft receptacle under the piston and a crankshaft journal for mounting a crankshaft bearing and an oil feed line on one side of the piston cylinder. The oil feed line is connected to a groove and the crankshaft journal and also to the crankshaft bearing to provide a passage through the bearing to the crankshaft. A passage extends from the oil groove to the crankshaft receptacle and is provided with an oil-spray nozzle which sprays oil onto an underside of the piston. The oil-spray nozzle has an element which is incorporated in the passage which extends from the oil groove to the crankshaft receptacle. A spray nozzle has a bottom region with outlets and a top region with inlets. A projection of the element is designed in such a way that it sits in the oil groove. The projection is of such a width that it is accommodated snugly in the oil groove.

It is known that piston oil-spray nozzles for cooling the pistons in the cylinder block are positioned below the cylinder barrels. These piston oil-spray nozzles require a pressurized oil supply, which is realized by means of a separate longitudinal bore in the cylinder block. This requires considerable design effort and additional production cost The inventors of the present invention have recognized that a cheaper, simpler, more robust device for providing piston cooling is desired.

SUMMARY OF THE INVENTION

The inventors of the present invention have disclosed an oil cooling system for an internal combustion engine with a crankshaft bearing cap 7 coupled to a crankshaft-bearing structural element 6 with an oil passageway 31 through said crankshaft bearing cap. The oil passageway 31 is adapted to direct lubricant toward adjacent pistons 38 disposed in engine cylinders 41. In one embodiment, a spray device is coupled to said crankshaft bearing device at said oil passageway 31. The oil passageway 31 is further coupled to a supply passageway 3 The supply passageway 3, as viewed in cross section, is arranged with a first section 8 in the crankshaft-bearing structural element 6 and with a second section 9 in the crankshaft-bearing cap 7, the second section 9 merging into the first section 8. In one embodiment, the supply passageway 31, as viewed in cross section is directed around approximately 40 to 60% of the circumference of the crankshaft-bearing shell 14. A through-opening 16 is arranged in the crankshaft-bearing shell 14 to provide lubricant to the crankshaft 17 disposed in the crankshaft-bearing shell 14.

In one embodiment, there are two spray nozzles coupled to the bearing cap 7. The centerlines of the spray nozzles are not parallel. In one embodiment, the spray nozzle is retained by retaining element 29 and secured to the bearing cap 7 by a screw 33.

Provision is advantageously made for the supply passageway, as viewed in cross section, to be arranged with a first section in the crankshaft-bearing structural element and with a second section in the crankshaft-bearing cap, the second section merging into the first section. Alternatively, the supply passageway is designed in a single section arranged in the crankshaft-bearing cap or a crankshaft-bearing-cap combination.

So that the supply passageway can be supplied with the coolant/lubricant, in particular with oil, the supply passageway is connected with its first section to a coolant/lubricant passage which opens into said section and which is incorporated in the crankshaft-bearing structural element. The crankshaft-bearing structural element may be, for example, a ladder frame. The coolant/lubricant passage may open out in the supply passageway without being directed through the crankshaft-bearing structural element.

With its first section, the supply passageway is advantageously of essentially triangular design as viewed in cross section, with a rounded tip oriented relative to its outer wall, a base leg being designed in accordance with the curvature of the crankshaft-bearing shell. With is second section, the supply passageway, with its outer wall, expediently preferably runs rectilinearly in a first region as viewed in cross section, the first region merging into a second region, the outer wall of which is designed in accordance with the curvature of the crankshaft-bearing shell.

So that the coolant/lubricant can pass to both the spray device and the crankshaft, it is favorable within the scope of the invention if the supply passageway as viewed in cross section is directed partly circumferentially around approximately 40 to 60%, preferably around approximately 45%, of the circumference of the crankshaft-bearing shell, the through-opening being expediently arranged in the crankshaft-bearing shell in the area of the second region of the second section of the supply passageway. It is also conceivable for the supply passageway to be directed fully circumerentially or more less partly circumferentially around the crankshaft-bearing shell.

In a preferred configuration of the invention, the spray device is designed as a spray nozzle which is accommodated in a locating hole of the crankshaft-bearing cap. So that the spray nozzle is locked against axial rotation, but also against release from the locating hole, provision is expediently made for the spray nozzle to be frictionally connected to the crankshaft-bearing cap via a retaining element. The spray nozzle may of course also be frictionally accommodated in the hole, so that the spray nozzle is adequately locked against rotation or slackening. However, it is also possible for the spray nozzle to be integrally connected to the crankshaft-bearing cap. To this end, for example, a welded connection or an adhesive connection may be provided. The coolant/lubricant is sprayed via the spray nozzle to a piston to be cooled.

In a further configuration of the invention, the spray device is integrated in the crankshaft-bearing cap itself as at least one directional and calibrated spray hole. Two spray holes, which are arranged at an angle to one another, are preferably integrated in the crankshaft-bearing cap. The spray holes assume the function of spray nozzles and can advantageously be integrated in the crankshaft-bearing cap in any desired position and orientation. The supplying with coolant/lubricant is of course effected via the supply passageway according to the invention, but may also be effected via conventional passages and/or supply passageways.

In both configurations with both spray nozzle and spray holes, it is favorable within the scope of the invention if a module is used, for example, with a ladder-frame structure, the crankshaft-bearing cap of which lies above a crankshaft axis.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Further advantageous configurations of the invention are disclosed in the subclaims and in the description of the figures below. In the drawing:

In the figures, the same parts are provided with the same designations. Parts are typically described only once.

DETAILED DESCRIPTION

Figure 1:
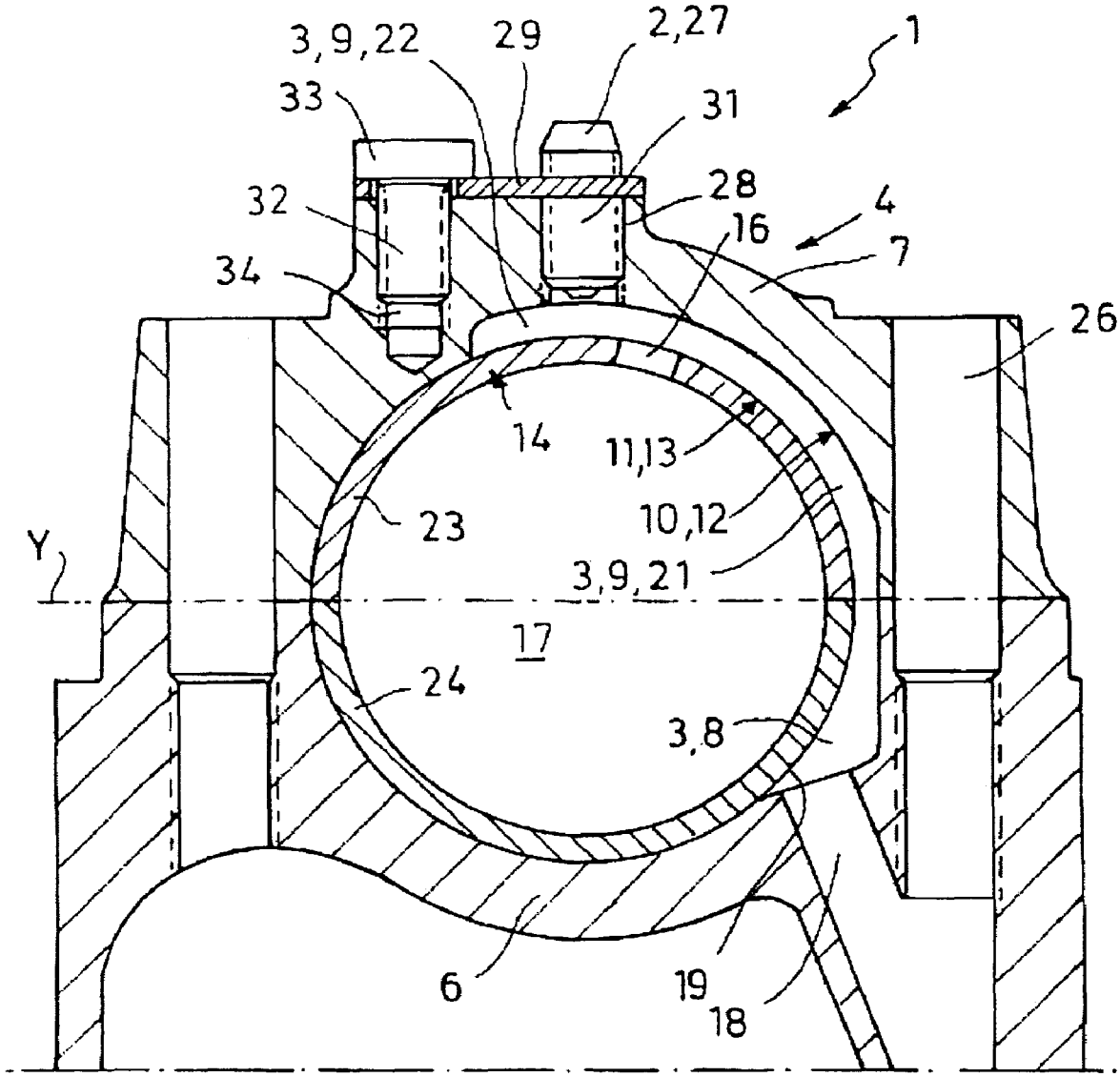
FIG. 1 shows a cross section through an internal combustion engine with a module in which a supply passageway is arranged.

FIG. 1 shows a detail of an internal combustion engine with a piston-cooling arrangement 1. The piston-cooling arrangement 1 has at least one spray device 2. The spray device 2 is supplied with a coolant/lubricant via at least one supply passageway 3. The supply passageway 3 is arranged in a module 4 which is composed of a crankshaft-bearing structural element 6 and a crankshaft-bearing cap 7. As viewed in cross section, the supply passageway 3 is arranged with a first section 8 in the crankshaft-bearing structural element 6 and with a second section 9 in the crankshaft-bearing cap 7, the second section 9 merging into the first section 8. The supply passageway 3 has an outer wall 10 and an inner wall 11 opposite it. The outer wall 10 is formed by an inner wall section 12 of the crankshaft-bearing structural element 6 and of the crankshaft-bearing cap 7. The inner wall 11 of the supply passageway 3 is formed by an outer wall section 13 of a crankshaft-bearing shell 14. The supply passageway 3 is thus defined on the one hand with its outer wall 10 by the inner wall section 12 of the crankshaft-bearing structural element 6 and of the crankshaft-bearing cap 7 and on the other hand with its inner wall 11 by the outer wall section 13 of the crankshaft-bearing shell 14 and is of channel-like design. The spray device 2 is assigned to the crankshaft-bearing cap 7 in the region of the supply passageway 3. The crankshaft-bearing shell 14 has a through-opening 16 in the region of the supply passageway 3, preferably in the region of its second section 9. The coolant/lubricant can thus be directed via the supply passageway 3 to both the spray device 2 and a crankshaft 17. The module 4 is screwed to a cylinder block (not shown) and secures the crankshaft 17.

The supply passageway 3 is connected with its first section 8 to a coolant/lubricant passage 18 opening into said section 8. The coolant/lubricant passage 18 is incorporated in the crankshaft-bearing structural element 6 and is connected to an oil gallery (not shown). The coolant/lubricant passage 18, coming from below the crankshaft main axis Y as viewed in cross section, is directed to the first section 8 of the supply passageway 3. The coolant/lubricant, preferably oil, is directed through the coolant/lubricant passage 18 into the supply passage 3, which supplies the spray device 2, but also the crankshaft 17, with coolant/lubricant, the coolant/lubricant passing through the through-opening 16 to the crankshaft 17. The coolant/lubricant passage 18 is preferably incorporated mechanically in the crankshaft-bearing structural element 6, but may also already be integrally cast during its production, for example during its production by casting, and/or may be incorporated manually with suitable aids.

With its first section 8, the supply passageway 3 is of essentially triangular design as viewed in cross section, with a rounded tip oriented relative to its outer wall 10. A base leg 19 of the first section 8 is designed in accordance with the curvature of the crankshaft-bearing shell 14.

With its second section 9, the supply passageway 3, with its outer wall, is incorporated in the crankshaft-bearing cap 7 in a first region 21 in such a way as to run preferably rectilinearly as viewed in cross section, the first region 21 merging into a second region 22 which is designed in accordance with the curvature of the crankshaft-bearing shell 14.

As can be seen from FIG. 1, the supply passageway 3 as viewed in cross section is directed around approximately 40 to 60%, preferably around approximately 45%, of the circumference of the crankshaft-bearing shell 14.

The crankshaft-bearing shell 14 is composed in two pieces of a top shell part 23 and a bottom shell part 24.

The through-opening 16 is arranged in the top shell part 23 preferably in the area of the second region 22 of the second section 9 of the supply passageway 3. In the exemplary embodiment shown, the through-opening 16, with respect to a zenith of the crankshaft-bearing axis 14, is arranged offset by about 20° as viewed in the clockwise direction. Of course, the through-opening 16 may be located in any position in the region of the supply passageway 3, in which case sufficient through-flow of the coolant/lubricant for sufficient lubrication of the crankshaft 17 is to be ensured.

The crankshaft-bearing cap 7 is connected to the crankshaft-bearing structural element 6. To this end, appropriate holes (screw channel) 26 are incorporated in both the crankshaft-bearing structural element 6 and the crankshaft-bearing cap 7, so that the crankshaft-bearing structural element 6 can be screwed to the crankshaft-bearing cap 7. The module 4 is connected, for example screwed, to a cylinder block (not shown).

In the exemplary embodiment shown in FIG. 1, the spray device 2 is designed as an oil-spray nozzle 27. To accommodate the oil-spray nozzle 27, a matching locating hole 28 is incorporated in the crankshaft-bearing cap 7. The oil-spray nozzle 27 is frictionally connected to the crankshaft-bearing cap 7 via a retaining element 29. In the exemplary embodiment shown, the retaining element 29 is of plate-shaped design as viewed in cross section and has an oil passageway 31 with the oil-spray nozzle 27 being directed through the oil passageway 31. Hole 32 has corresponding screw 33, the screw 33 being screwed into a corresponding tapped hole 34 in the crankshaft-bearing cap 7, so that the oil-spray nozzle 27 is adequately locked against rotation and release from the locating hole 28.

Figure 2:
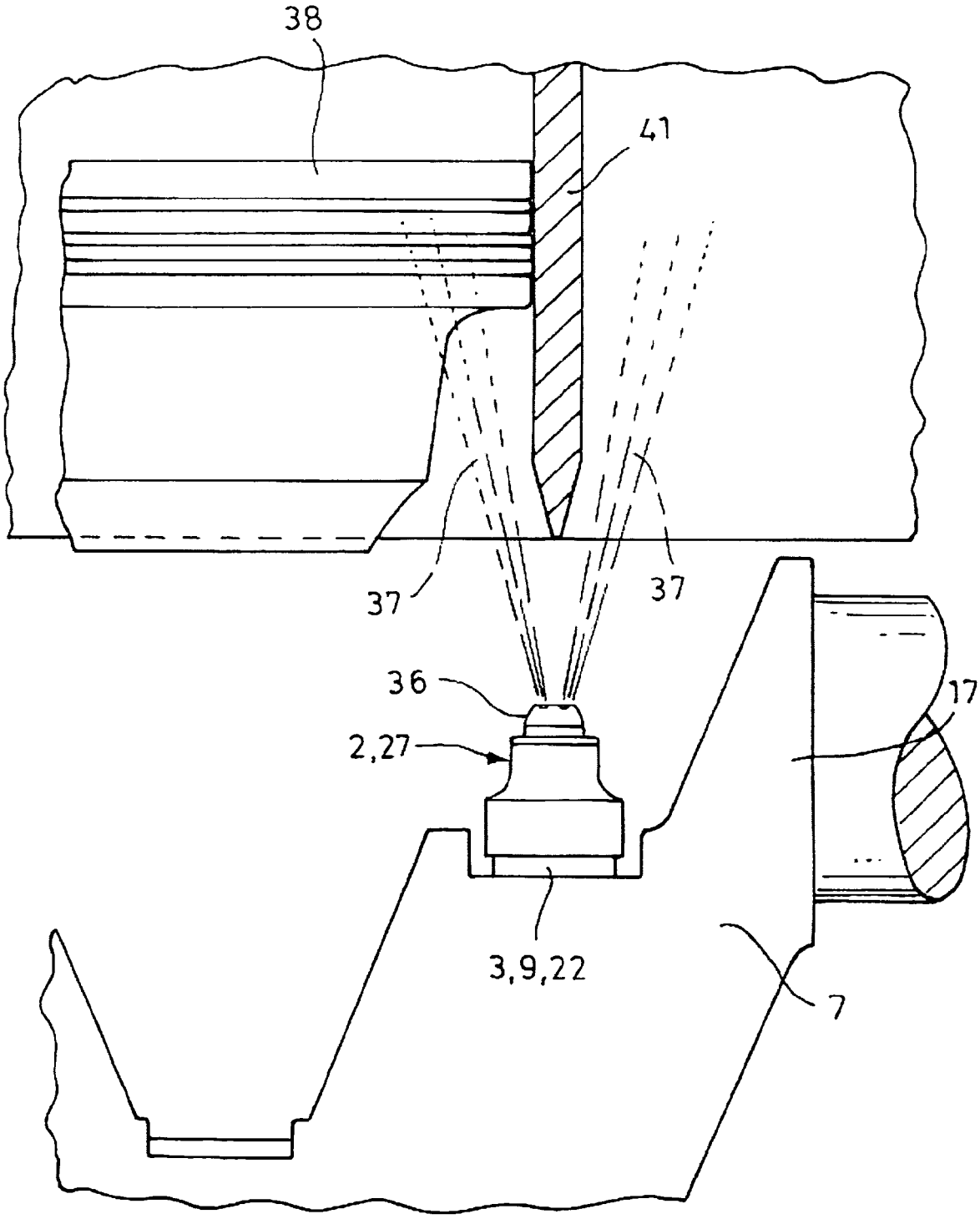
FIG. 2 shows an enlargement from FIG. 1.

FIG. 2 shows the spraying end 36, projecting from the crankshaft-bearing cap 7, of the oil-spray nozzle 27. Directional spray holes are incorporated in the spraying end 36, so that oil-spray jets 37 are sprayed onto adjacent pistons 38.

Figure 3:
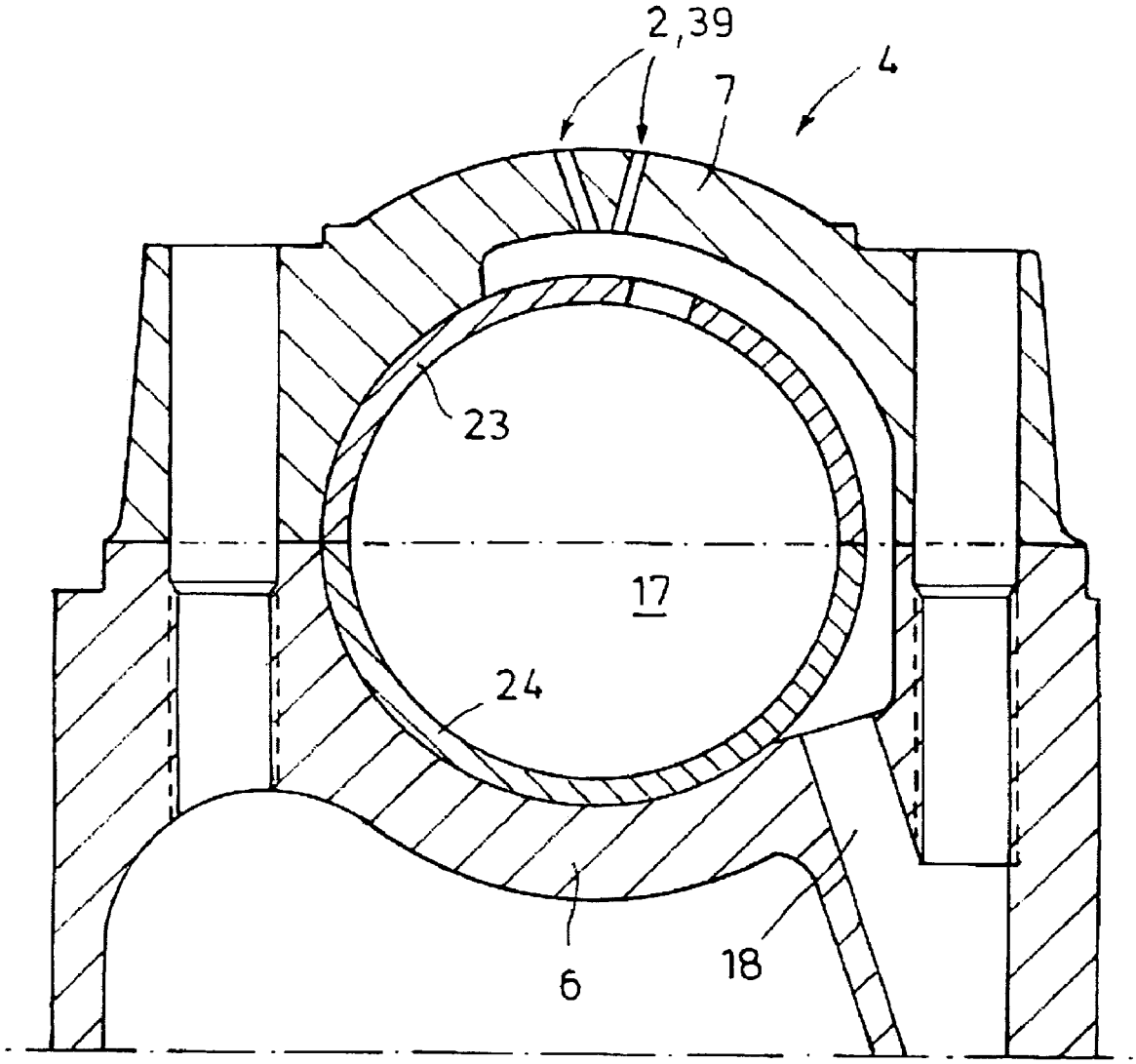
FIG. 3 shows the cross section from FIG. 1 with a further embodiment of a spray device.
Figure 4:
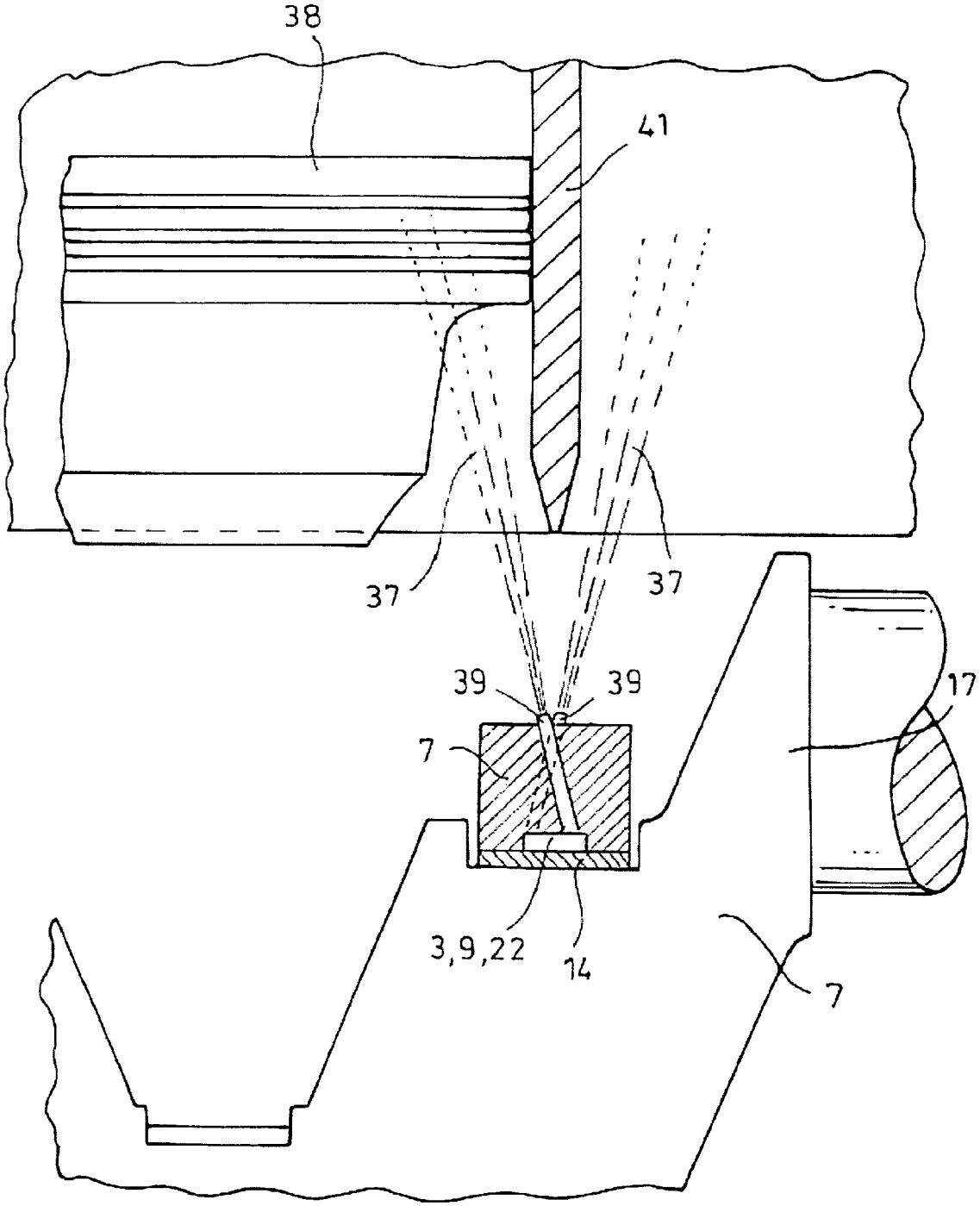
FIG. 4 shows an enlargement from FIG. 3, FIGS. 5 to 13 show the cross section from FIG. 1 in alternaive configurations of the supply passageway with its coolant/lubricant passage which opens out therein.

A further configuration of the spray device 2 is shown in FIGS. 3 and 4. In FIG. 3, the spray device 2 is formed from directional and calibrated spray holes 39 which are directly integrated into the crankshaft-bearing cap 7. The spray holes 39 are arranged at an acute angle to one another with respect to the crankshaft main axis Y.

Except for the different configuration of the spray device 2 as spray holes 39, the exemplary embodiment according to FIG. 3 has no differences from the exemplary embodiment according to FIG. 1.

In the exemplary embodiment shown in FIG. 3, the spray holes 39 are directed continuously through the crankshaft-bearing cap 7 and open into the second region 22 of the second section 9 of the supply passageway 3.

It is clearly shown in FIG. 4 that the two spray holes 39 are incorporated at an axial distance from one another in the crankshaft-bearing cap 7 and intersect one another, as it were. The spray holes 39 may be incorporated in any desired position and orientation in the crankshaft-bearing cap 7.

The oil-spray jets 37 are sprayed through the respective spray hole 39 or through the spray nozzle 27 past a cylinder barrel 41 to the respective piston 38 in order to cool the latter.

FIGS. 5 to 13 show alternative configurations of the supply passageway 3 with the associated coolant/lubricant passage 18. Although the exemplary embodiments in FIGS. 5 to 13 show the embodiment with the oil-spray nozzle 27, it is of course possible to also use this configuration in the embodiment having calibrated and directional spray holes 39.

In the exemplary embodiments in FIGS. 5 to 13, the supply passageway 3 is arranged entirely with only one section in the crankshaft-bearing cap 7 or a crankshaft-bearing-cap combination. In the exemplary embodiment shown in FIG. 5, the supply passageway 3 is directed partly circumferentially around approximately 10 to 20% of the circumference of the crankshaft-bearing shell 14. In this case, the supply passageway 3, with respect to a zenith of the crankshaft-bearing shell 14, extends by about 40° beyond the zenith as viewed in the clockwise direction and is designed to be somewhat shorter than the second region 22 from FIGS. 1 and 3. The coolant/lubricant passage 18 is incorporated in the crankshaft-bearing cap 7 or the crankshaft-bearing-cap combination as a transverse bore 42 toward a longitudinal bore 43 for the oil supply, the longitudinal bore 43 also being incorporated in the crankshaft-bearing cap 7 or the crankshaft-bearing-cap combination. The longitudinal bore 43 is of round design as viewed in cross section and is arranged above the crankshaft main axis Y.

Figure 5:
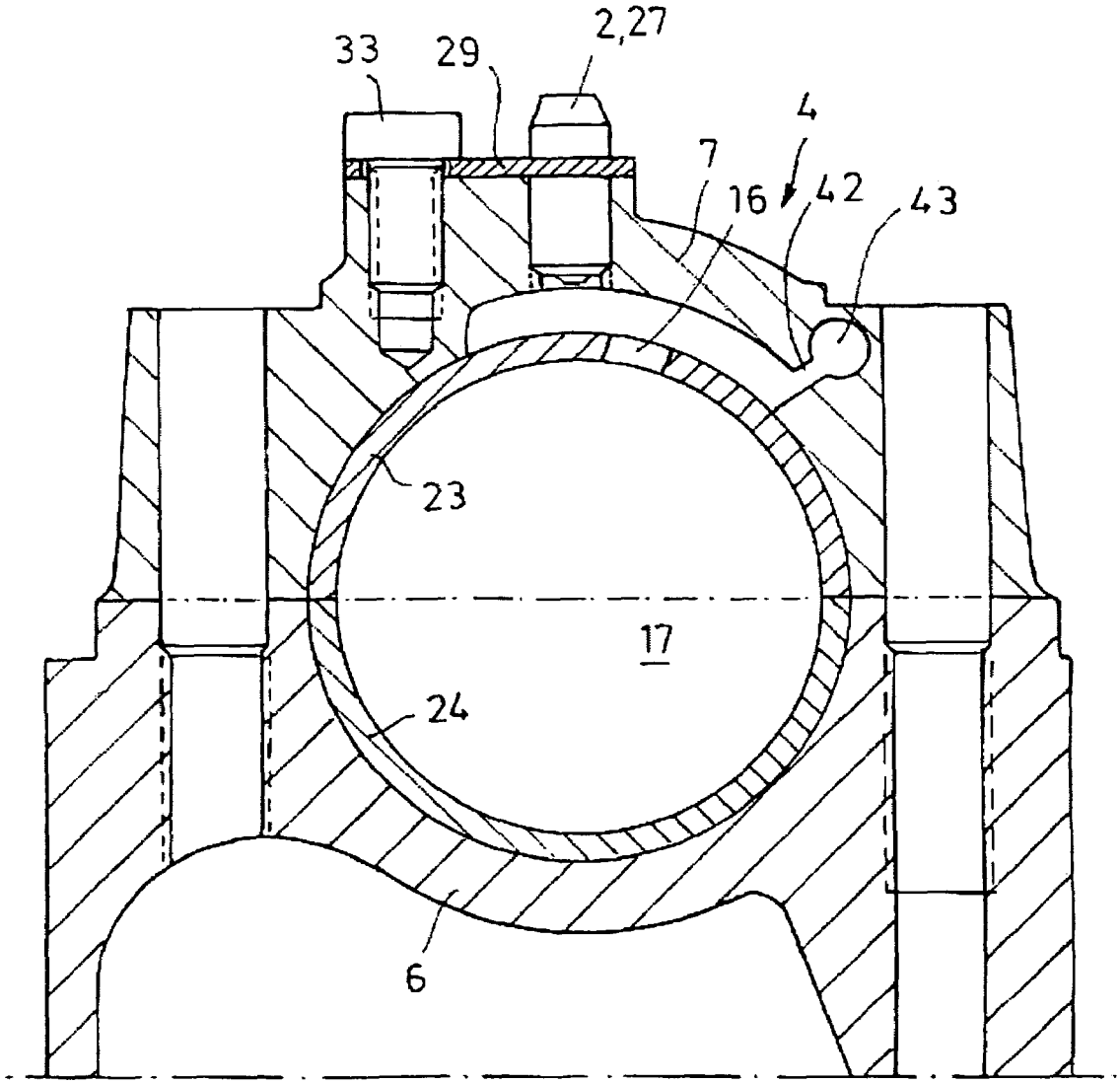
Figure 6:
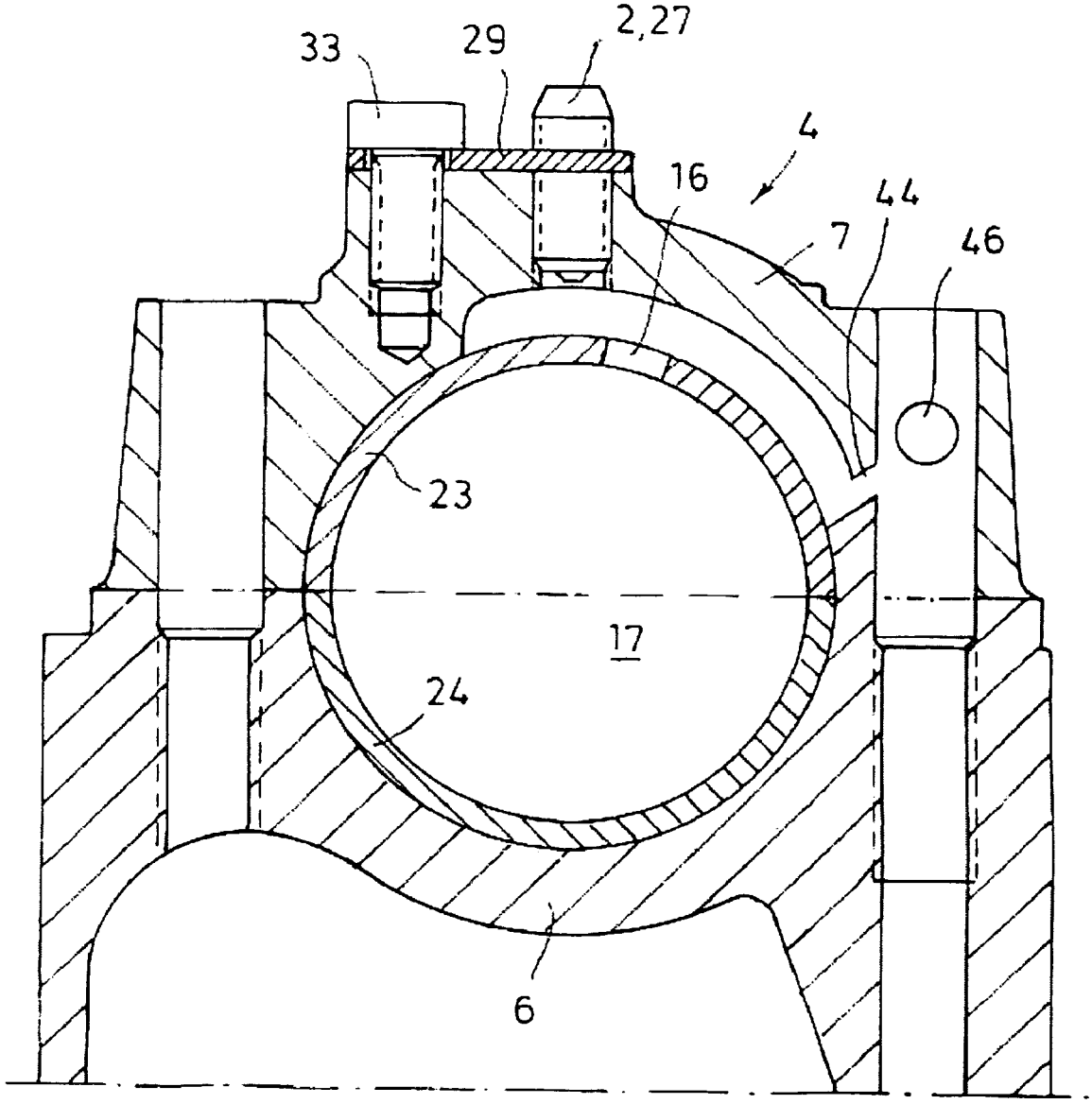

In the exemplary embodiment shown in FIG. 6, the supply passageway 3 is designed to be slightly longer relative to the exemplary embodiment from FIG. 5 and starts at about 80° with respect to the zenith of the crankshaft-bearing shell 14 and corresponds in its extent to approximately the second region 22 from FIGS. 1 and 3. The coolant/lubricant passage 18 is designed as a transverse bore 44 and is connected to a longitudinal bore 46 for the oil supply. Both the transverse bore 44 and the longitudinal bore 46 are incorporated in the crankshaft-bearing cap 7 or the crankshaft-bearing-cap combination. The longitudinal bore 46 is of round design as viewed in cross section and is arranged inside the hole (screw channel) 26 as viewed in cross section.

Figure 7:
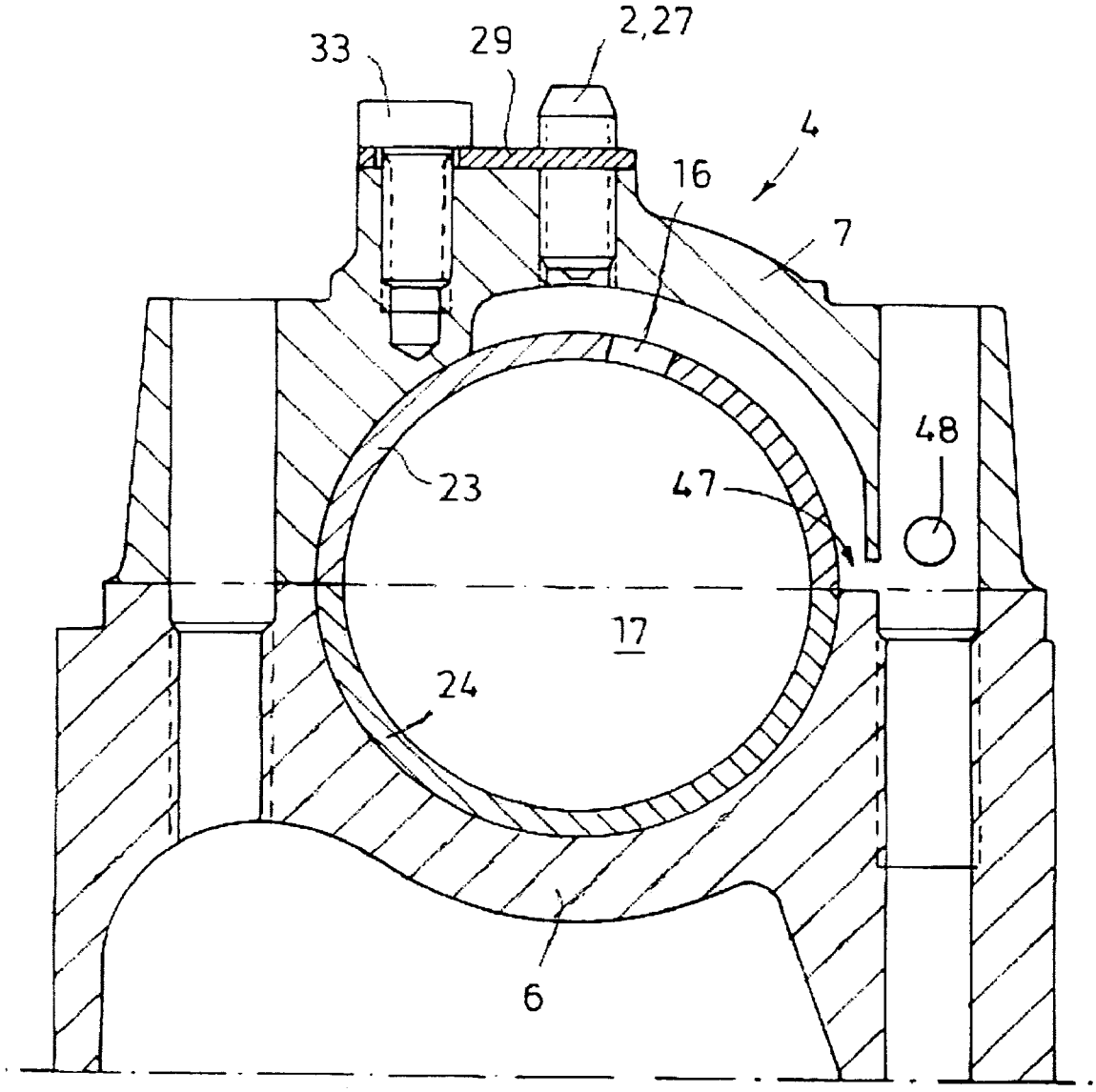

In FIG. 7, the supply passageway 3 is designed in its extent so as to correspond to the second region 22 with a section of the first region 21. In this exemplary embodiment, the supply passageway 3 extends approximately from the crankshaft main axis Y, which may be referred to as parting plane. The coolant/lubricant passage 18 is connected as transverse passage 47 to a longitudinal bore 48 for the oil supply. The longitudinal bore 48 is round as viewed in cross section and is arranged slightly above the crankshaft main axis Y in the hole (screw channel) 26.

Figure 8:
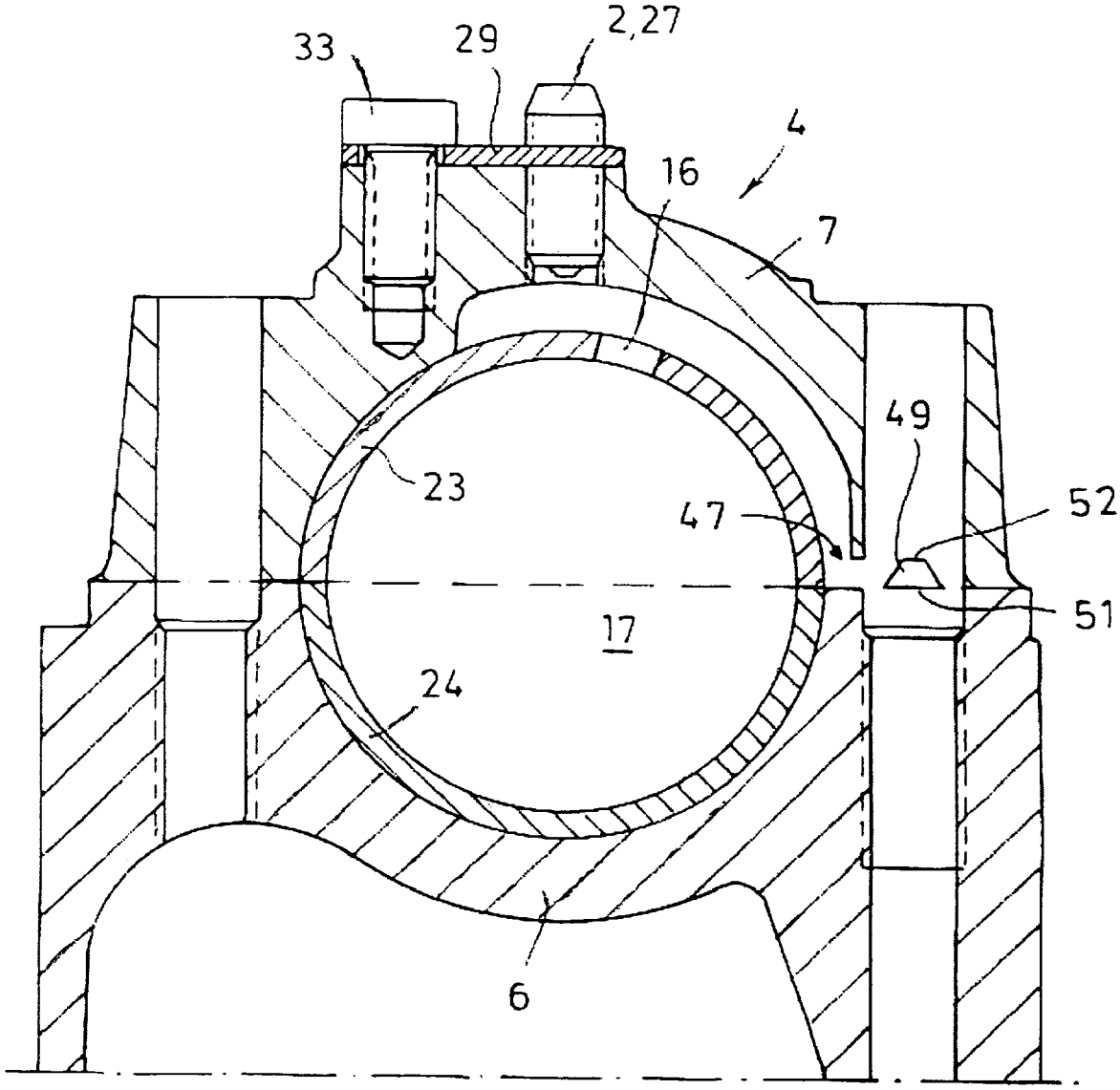

In contrast thereto, the exemplary embodiment from FIG. 8 has a longitudinal passage 49 for the oil supply which is of frustoconical design as viewed in cross section. The longitudinal passage 49 is arranged with its base side 51 approximately congruently with the crankshaft main axis Y and extends upward with its opposite frustum surface 52.

Figure 9:
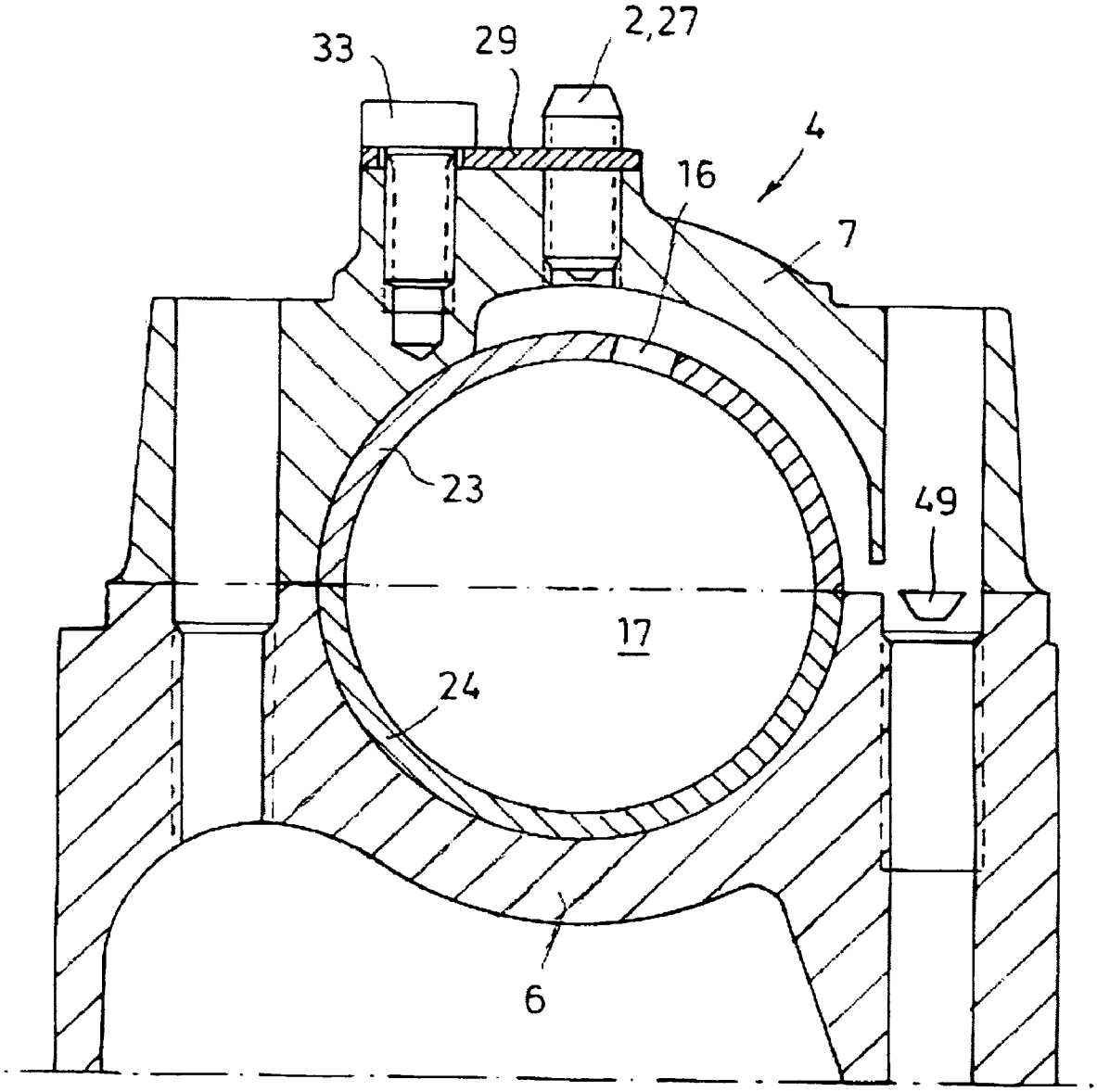

In the exemplary embodiment shown in FIG. 9, however, the longitudinal passage 49 is arranged in mirror image to the arrangement from FIG. 8 and extends in the opposite direction with its frustum surface 52.

In the exemplary embodiments according to FIGS. 6, 7 and 8, the longitudinal passage 46, 48 and 49, respectively, is directed through the hole (screw channel) 26 in the crankshaft-bearing cap 7 or the crankshaft-bearing-cap combination, the longitudinal passage 49 in the exemplary embodiment according to FIG. 9 being directed through the hole (screw channel) 26 in the crankshaft-bearing structural element 6.

Figure 10:
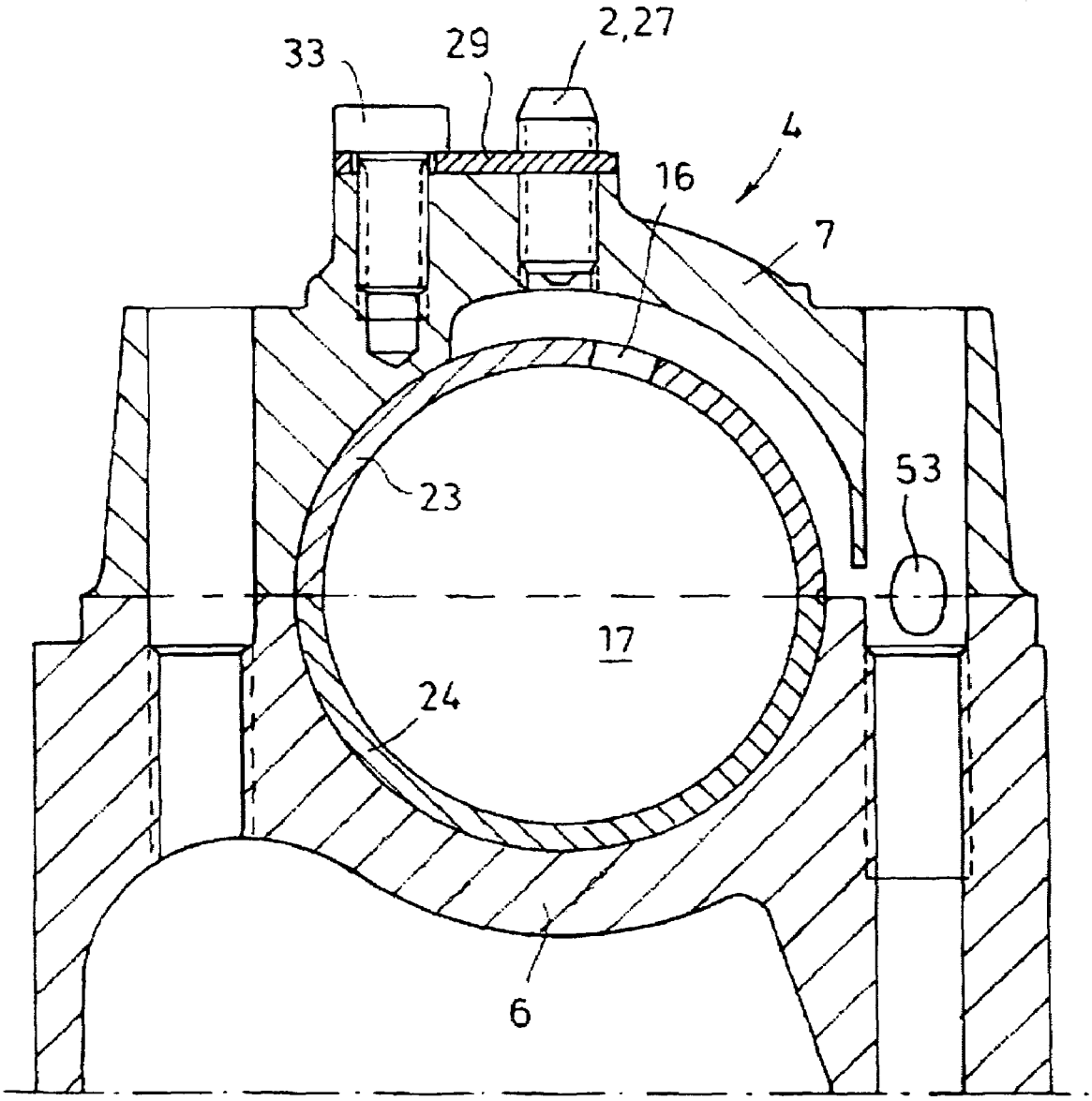
Figure 11:
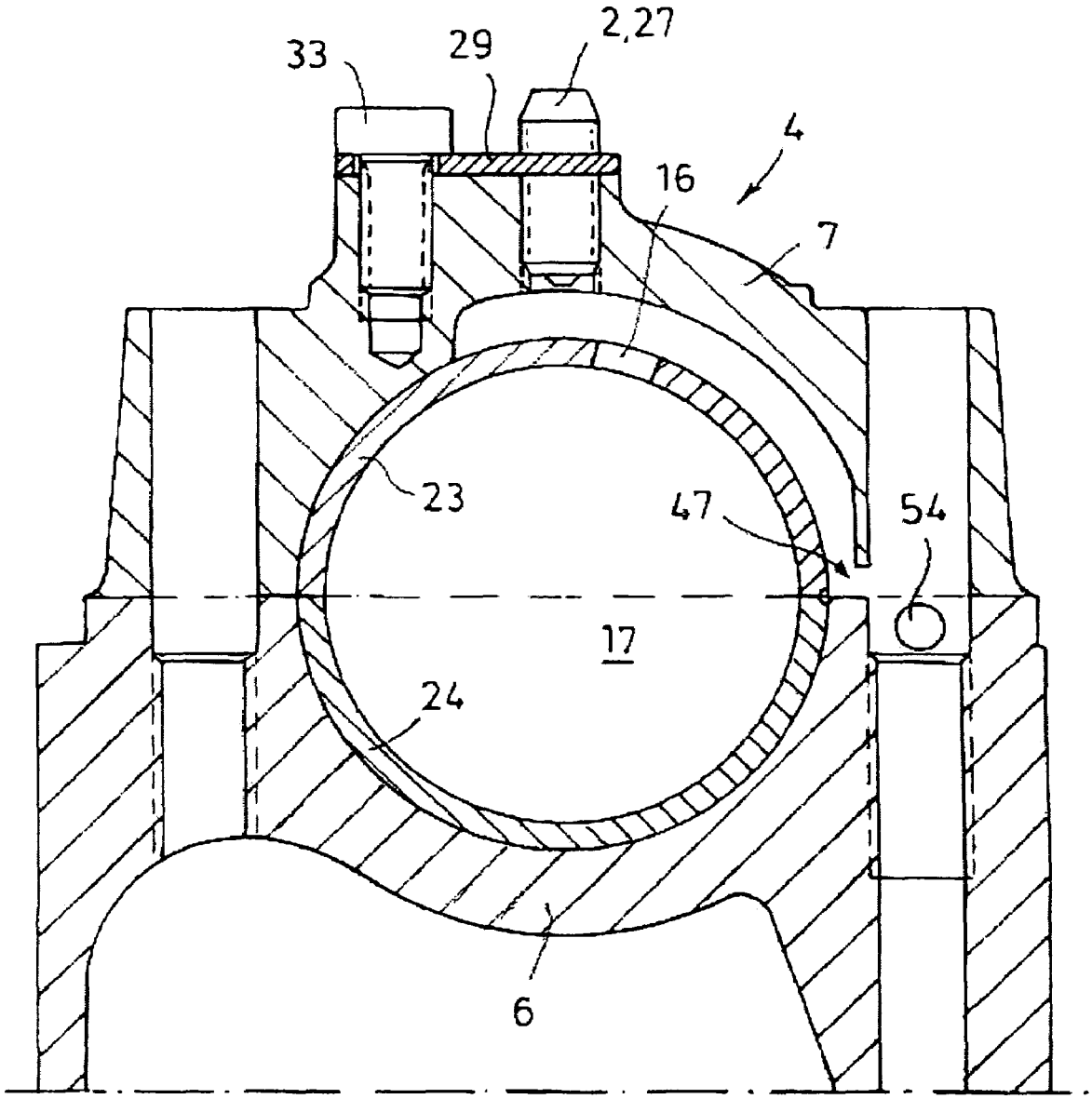

In the exemplary embodiment shown in FIG. 10, the supply passageway 3 is of identical design to the exemplary embodiments in FIGS. 7 to 9. The transverse passage 47 is connected to a longitudinal passage 53 which is of oval design as viewed in cross section and is arranged with its halves equally above and below the crankshaft bearing axis Y (parting plane). The longitudinal passage 53 is therefore arranged with one half in the crankshaft-bearing cap 7 or the crankshaft-bearing-cap combination and with its other half in the crankshaft-bearing structural element 6. According to the exemplary embodiment from FIG. 11, the transverse passage 47 is connected to a longitudinal bore 54 which is of round design as viewed in cross section and is arranged in the crankshaft-bearing structural element 7.

Figure 12:
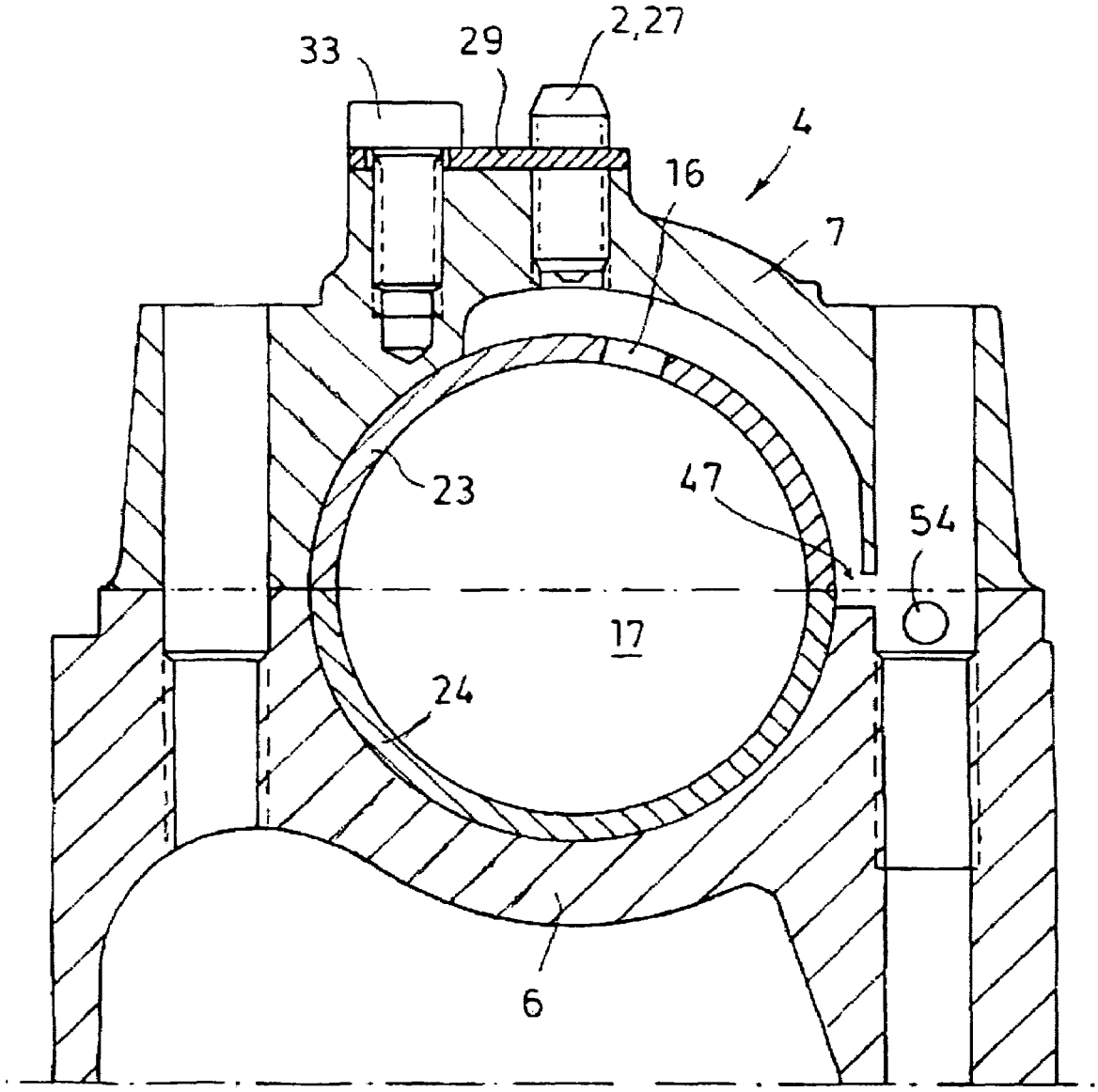
Figure 13:
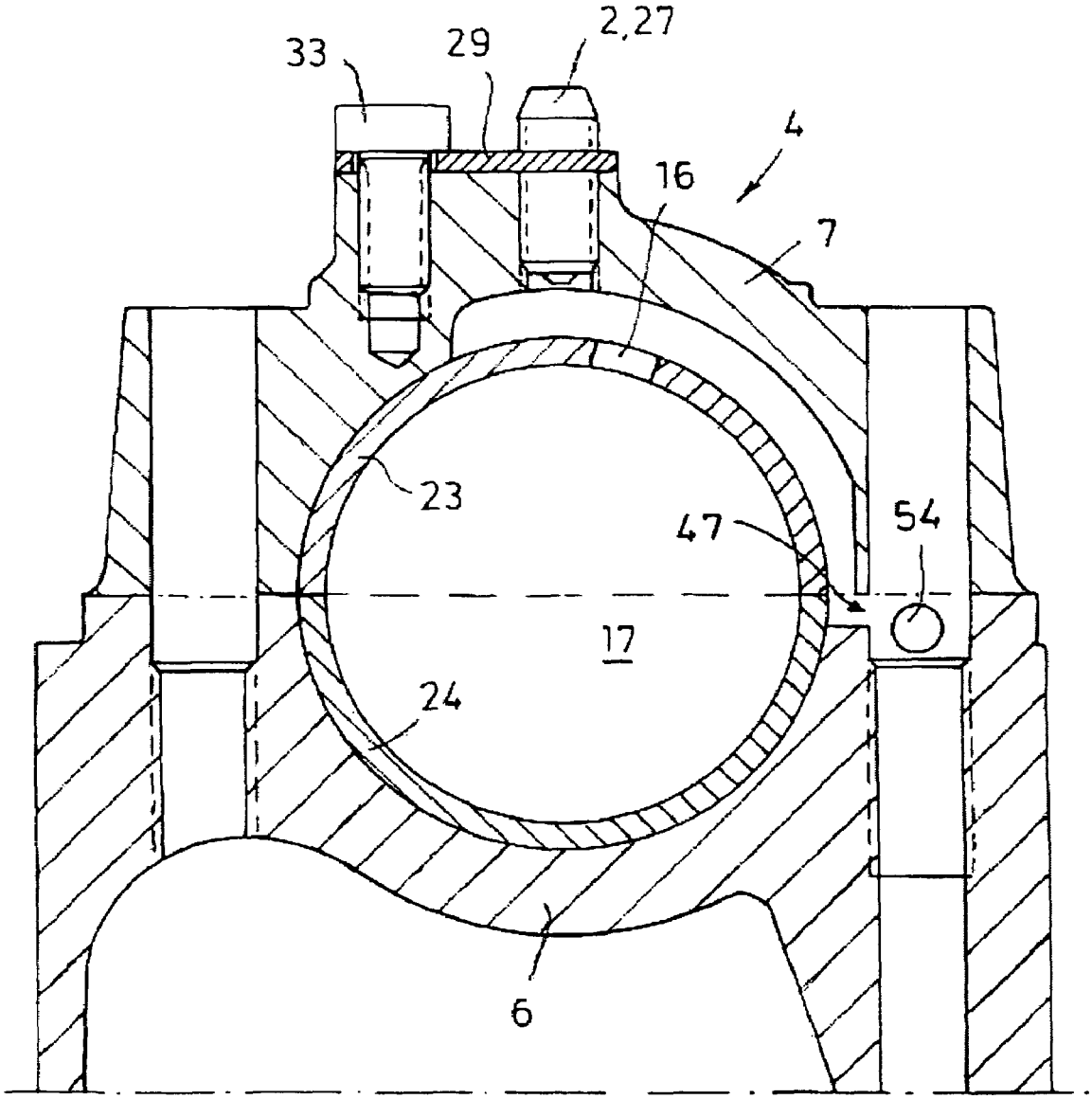

In the exemplary embodiments in FIGS. 5 to 11, the coolant/lubricant passage 18 or the respective transverse bores or passages 42, 44, 47 are arranged entirely in the crankshaft-bearing cap 7 or the crankshaft-bearing-cap combination. In contrast thereto, the coolant/lubricant passage 18 or its transverse passage 47 according to the exemplary embodiment from FIG. 12 is arranged both in the crankshaft-bearing cap 7 or the crankshaft-bearing-cap combination and in the crankshaft-bearing structural element 6. In this case, the transverse passage 47 is divided into two equal halves by means of the crankshaft main axis (parting plane) Y. The longitudinal bore 54 is designed and arranged in accordance with the exemplary embodiment from FIG. 11. In FIG. 13, however, the transverse passage 47 is arranged entirely in the crankshaft-bearing structural element 6.

The longitudinal bores or passages shown by way of example in FIGS. 5 to 13 may be both directed through the hole (screw channel) 26 and arranged outside it. The transverse passage may be arranged in the parting plane, in which case any desired, appropriate shape and position are of course conceivable. The transverse passage is preferably arranged in the parting plane, since said transverse passage, in this advantageous arrangement, can already be incorporated during the production, in particular during production by casting, without additional rework being necessary. Of course, the individual geometrical designs, which are different as viewed in cross section, of the respective passages or bores are not restricted to those described and can be combined with one another in an appropriate manner. But the respective longitudinal and transverse bores may also be produced as passages by casting. In production by casting, the supply passageway 3, as viewed in cross section, with its second section 9, may be inclined with its outer wall 10 in a first region 21 preferably by 2 to 3° in the direction of the screw channel 26.

In the preferred exemplary embodiments, in each case only one module 4 is shown and described. Of course, in multi-cylinder internal combustion engines, a corresponding number of modules 4 can be used, which preferably form a combination.

It is conceivable in the case of engines having a plurality of cylinder banks, in particular at a cylinder angle of 180°, to combine two crankshaft-bearing structural elements 6 with one another. The function of the crankshaft-bearing cap 7 or crankshaft-bearing-cap combination dispensed with as a result is assumed in this case by the second crankshaft-bearing structural element. Of course, the function of the crankshaft-bearing cap or crankshaft-bearing-cap combination which has been dispensed with can also be assumed by the first crankshaft-bearing structural element 6. It is therefore entirely within the scope of the invention to appropriately apply the design described above in each case according to FIGS. 1 to 13 to the combination of two crankshaft-bearing structural elements.

A number of embodiments of the invention have been described. Nevertheless, it will be understood that various modifications may be made without departing from the spirit and scope of the invention. Accordingly, other embodiments are within the scope of the following claims.

We claim:

1. An oil cooling system for an internal combustion engine, comprising:

a crankshaft bearing cap (7) coupled to a crankshaft-bearing structural element (6); and an oil passageway (31) through said crankshaft bearing cap wherein a centerline of said oil passageway (31) is directed toward a piston (38), said piston being disposed in engine cylinders (41).

2. The system of claim 1, further comprising: a spray nozzle (27) coupled to said crankshaft-bearing cap (7).

3. The system of claim 1, further comprising: a spray device (2) coupled to said crankshaft bearing device at said oil passageway (31).

4. The system of claim 1 wherein said oil passageway (31) is further coupled to a supply passageway (3).

5. The system of claim 4, wherein said supply passageway (3), as viewed in cross section, is arranged with a first section (8) in said crankshaft-bearing structural element (6) and with a second section (9) in the crankshaft-bearing cap (7), the second section (9) merging into the first section (8).

6. The system of claim 1, wherein said supply passageway (31) is defined by an inner wall of said bearing cap (7) and by an outer wall of a crankshaft-bearing shell (14), said crankshaft bearing shell (14) being disposed inside said bearing cap (7) and said crankshaft-bearing structural element (6).

7. The system of claim 6 wherein said first section (8) of said supply passageway (31) is of essentially triangular design as viewed in cross section, with a rounded tip oriented relative to its outer wall, a base leg (19) being designed in accordance with the curvature of the crankshaft-bearing shell (14).

8. The system of claim 6 wherein said supply passageway (31) as viewed in cross section is directed around approximately 40 to 60% of the circumference of said crankshaft-bearing shell (14).

9. The system of claim 6 wherein a through-opening (16) is arranged in said crankshaft-bearing shell (14).

10. The system of claim 9 wherein said through-opening (16) connects said supply passageway (3) to a crankshaft (17), said crankshaft (17) being disposed within said crankshaft-bearing shell (14).

11. A piston-cooling system for an internal combustion engine, comprising:

a crankshaft bearing cap (7);

an oil passageway (31) through said crankshaft bearing cap (7) wherein a centerline of said oil passageway (31) is directed generally toward said piston (38), said piston being disposed in engine cylinder (41); and at least one supply passageway (3) coupled to said spray device, said supply passageway (3) adapted to supply lubricant to said oil passageway (31).

12. The system of claim 11, further comprising: a spray nozzle (27) coupled to said crankshaft-bearing cap (7).

13. The system of claim 12, further comprising: a retaining element (29) coupled to said spray nozzle (27) wherein said retaining element (29) is secured to said bearing cap (7) by a screw (33).

14. The system of claim 12 wherein said spray nozzle (27) has two orifices.

15. The system of claim 12 wherein an orifice of said spray nozzle (27) is directed and calibrated.

16. The system of claim 12, wherein said spray nozzle (27) is frictionally connected to said crankshaft-bearing cap (7).

17. The system of claim 11 comprising an additional oil passageway through said crankshaft bearing cap (7) wherein a centerline of said additional oil passageway is not parallel a centerline of said oil passageway (31).

18. A piston-cooling system for an internal combustion engine, comprising:

a crankshaft bearing cap (7);

an oil passageway (31) through said crankshaft bearing cap (7);

at least one supply passageway (3) coupled to said spray device, said supply passageway (3) adapted to supply lubricant to said oil passageway (31); and a spray nozzle (27) frictionally connected to said crankshaft-bearing cap (7).

* * * * *